US007476104B2

(12) United States Patent
Marmaropoulos et al.

(10) Patent No.: US 7,476,104 B2
(45) Date of Patent: Jan. 13, 2009

(54) FABRIC INTERCONNECT

(75) Inventors: George Marmaropoulos, Yorktown Heights, NY (US); Giang Vu, New York, NY (US); Mama Jack Kyriakos, London (GB)

(73) Assignee: Koninklijke Philips Electronics, N.V., Eindhoven (NL)

( * ) Notice: Subject to any disclaimer, the term of this patent is extended or adjusted under 35 U.S.C. 154(b) by 255 days.

(21) Appl. No.: 10/560,588

(22) PCT Filed: Jun. 15, 2004

(86) PCT No.: PCT/IB2004/050913

§ 371 (c)(1),
(2), (4) Date: Dec. 12, 2005

(87) PCT Pub. No.: WO2004/110192

PCT Pub. Date: Dec. 23, 2004

(65) Prior Publication Data

US 2007/0093134 A1 Apr. 26, 2007

Related U.S. Application Data

(60) Provisional application No. 60/479,232, filed on Jun. 17, 2003.

(51) Int. Cl.
*H01R 33/00* (2006.01)

(52) U.S. Cl. ..... 439/37

(58) Field of Classification Search ..... 439/37, 439/45, 669, 668, 675

See application file for complete search history.

(56) References Cited

U.S. PATENT DOCUMENTS

| | | | | |
|---|---|---|---|---|
| 4,097,104 | A * | 6/1978 | Furey et al. | 439/269.1 |
| 4,596,053 | A * | 6/1986 | Cohen et al. | 361/220 |
| 4,777,344 | A * | 10/1988 | Nash et al. | 219/211 |
| 5,371,326 | A * | 12/1994 | Clearwaters-Dreager et al. | 174/128.1 |
| 5,390,433 | A * | 2/1995 | Brady | 38/79 |
| 5,487,759 | A | 1/1996 | Bastyr et al. | |
| 5,531,601 | A * | 7/1996 | Amoroso | 439/37 |
| 5,975,913 | A * | 11/1999 | Wada et al. | 439/45 |
| 6,210,771 | B1 * | 4/2001 | Post et al. | 428/100 |
| 6,324,053 | B1 * | 11/2001 | Kamijo | 361/683 |
| 6,619,835 | B2 * | 9/2003 | Kita | 368/281 |
| 6,645,008 | B2 * | 11/2003 | Massey et al. | 439/581 |
| 6,729,025 | B2 * | 5/2004 | Farrell et al. | 29/854 |
| 6,817,867 | B1 * | 11/2004 | Carr et al. | 439/37 |
| 7,083,474 | B1 * | 8/2006 | Fleck et al. | 439/668 |
| 2002/0111777 | A1 | 8/2002 | David | |
| 2006/0089054 | A1 * | 4/2006 | Woo | 439/668 |
| 2006/0128169 | A1 * | 6/2006 | Marmaropoulos et al. | 439/37 |

* cited by examiner

*Primary Examiner*—Renee Luebke
*Assistant Examiner*—L Tsukerman

(57) ABSTRACT

There is provided a fabric interconnect comprising a portion of a garment manufactured to contain a seamless tube-like elastic chamber to enable insertion of an electronic device having a conductive portion, wherein the chamber has a first inner surface that is substantially electrically conductive and a second inner surface that is substantially electrically non-conductive, and at least one fabric electrode coupled to the first inner surface. The electronic enclosure includes an outer casing having at least one conductive area. The electronic enclosure can be aligned in the chamber to a conducting and non-conducting position, by forcing the conducting area of the electronic enclosure to be in contact with the (conductive) first inner surface of the fabric interconnect, thereby turning the electronic device "on" and "off". For example, by rotating the electronic device within the chamber or by pushing or pulling the electronic device to a predetermined position.

12 Claims, 4 Drawing Sheets

FABRIC INTERCONNECT

CROSS REFERENCE TO RELATED APPLICATION

This application claims the benefit of U.S. provisional application Ser. No. 60/479,232 filed Jun. 17, 2003, which is incorporated herein by reference.

The present invention relates to a fabric interconnect system. More particularly, the present invention relates to a fabric interconnect system for wearable conductive fibers in various sewn or woven fabrics used as conductive traces, bio-sensors, electrodes.

The use of integrated electronic and conductive fibers in various sewn or woven fabrics used as conductive traces, bio-sensors, electrodes, and other wearable electronic devices are well known. However, one drawback of contemporary wearable electronic applications is that some of the electronics cannot be integrated into the fabric. This is due mainly because of washability issues. For example, in the case of a Wearable Heart Rate Monitor (WHRM) device for general sport applications, the electrodes can be fully made of fabric and can be fully integrated into a garment such as a running top. The electronics though that collect the data from the electrodes and transmit them wirelessly to a watch or similar device are contained in a separate small unit which can be attached onto the garment in such a way that it can make good electrical contact with the tracking connected to the fabric electrodes. For manufacturing cost purposes it is highly desirable that the whole garment together with the electrodes, tracking and the interconnect method are all made at once in one machine in a seamless process. Thus, there is a need for a fabric interconnect without the above noted drawbacks. The preferred embodiments of the present invention fulfill this need.

It is an object of the present invention to provide an improved fabric interconnect method for attaching an electronics device, such as various wearable electronic devices and/or sensors, onto a garment with integrated fabric electrodes.

It is another object of the present invention to provide such a fabric interconnect method that ensures mechanical and electrical connection.

It is yet another object of the present invention to provide such a fabric interconnect method that enables manufacturing in a knitting machine with a minimum of post knitting interventions.

These and other objects and advantages of the present invention are achieved by a fabric interconnect comprising a portion of a garment manufactured to contain a seamless chamber to enable insertion of an electronic device having a conductive portion, wherein the chamber has a first inner surface that is substantially electrically conductive and a second inner surface that is substantially electrically non-conductive, and at least one fabric electrode coupled to the first inner surface. The electronic enclosure includes an outer casing having at least one conductive area. The electronic enclosure can be aligned in the chamber to a conducting and non-conducting position, by forcing the conducting area of the electronic enclosure to be in contact with the (conductive) first inner surface of the fabric interconnect, thereby turning the electronic device "on" and "off". For example, by rotating the electronic device within the chamber or by pushing or pulling the electronic device to a predetermined position. Preferably, the chamber is flexible and elastic, as well as having a tube-like shape.

The present invention is more fully understood by reference to the following detailed description of a preferred embodiment in combination with the drawings identified below.

Figure 1:
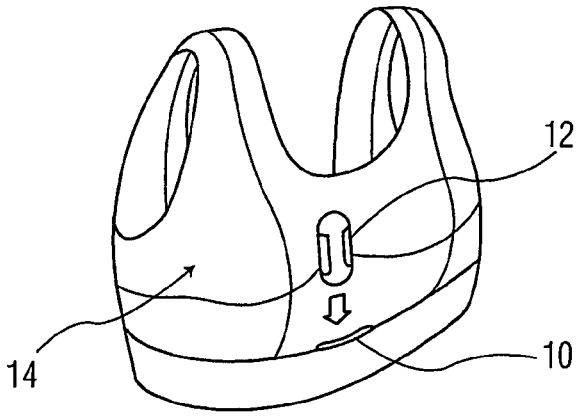
FIG. 1 is a front view of a garment with a fabric interconnect in accordance with the present invention.
Figure 2:
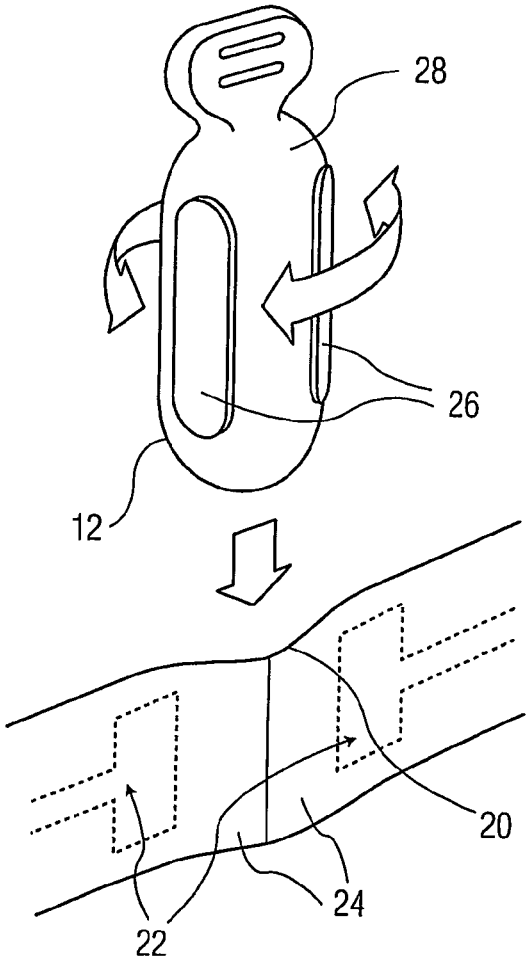
FIG. 2 is a view of the fabric interconnect of FIG. 1 and an electronic device for use with the fabric interconnect.
Figure 3:
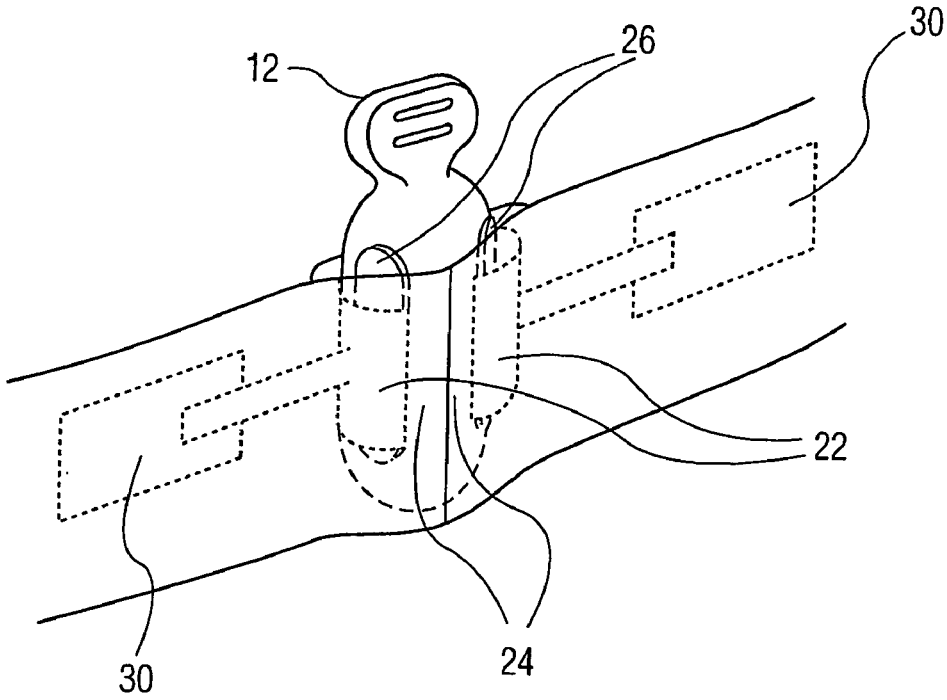
FIG. 3 is a view of the portion of the fabric interconnect of FIG. 2 with the electronic device inserted.

Referring to the drawings and, in particular, FIG. 1, there is shown an improved fabric interconnect in accordance with the present invention generally represented by reference numeral 10. The present invention enables an electronics enclosure 12, for example, of a Heart Rate Monitor (HRM), to be attached onto a garment 14 with fabric electrodes. FIG. 2 is a view of the fabric interconnect of FIG. 1 and electronic enclosure 12 for use with the fabric interconnect. FIG. 3 is a view of the portion of the fabric interconnect of FIG. 2 with electronic enclosure 12 inserted.

Referring to FIGS. 1, 2 and 3, fabric interconnect 10 comprises a portion of garment 14 having a seamless chamber 20 formed by a first inner surface 22 and a second inner surface 24. First inner surface 22 is substantially electrically conductive. Second inner surface 24 is substantially electrically non-conductive. In addition, at least one fabric electrode 30 is coupled to the conductive portion (first inner surface 22) of chamber 20.

Advantageously, manufacturing costs are reduced, since the entire garment together with the electrodes, tracking and the interconnect method are all made at once in one machine in a seamless process. An example of such a machine is the santoni circular knitting machine.

Fabric interconnect 10 includes a seamless tube or chamber having a substantially tubular/oval shape. However, alternative shapes for fabric interconnect 10 can also be used including circular or square. Preferably, fabric interconnect 10 is made of a material with elasticity.

Electronic enclosure 12 includes a casing 28 that has conductive areas 26. For example, casing 28 may be made of any conventional material such as plastic and conductive areas 26 may be made of conductive carbonized plastic. Conductive areas 26 are internally connected to, and part of, an electronics circuit (not shown) inside the enclosure, which requires selective opening and closing of the connection with the electrodes 22 of garment 14. As noted above the chamber or tube has an opening (which is post knitting intervention) that allows the insertion of electronics enclosure 12 into the chamber.

Electronic enclosure 12 can be aligned in the chamber to a conducting and non-conducting position, thereby turning the electronic device "on" and "off". For example, by rotating electronic enclosure 12 within the chamber a user can bring the conductive areas of the inner portion of the chamber in contact with the outer conductive surface area of the electronic device and therefore switch the electronic device on. In a similar manner the electronic enclosure 12 may be inserted into the chamber but be switched off by being rotated so that there is no electrical contact between respective conductive portions or areas.

In this embodiment, elasticity of the fabric interconnect walls of the chamber provides the necessary force to keep the electronic device in the chamber as well as the force to keep a good electrical contact between the respective conductive areas. However, as one skilled in the art will recognize, other methods by be utilized, such as a fabric latch or button may be sewn into the garment.

Referring to FIG. 3, fabric interconnect 10 is shown with the insertion of electronic enclosure 12. The insertion of electronic enclosure 12 enables the conductive area 26 of the electronic device to be in contact with the conductive first inner surface 22 of fabric interconnect 10. The contact of conductive area 26 and first inner surface 22 forms an interconnection.

Figure 4:
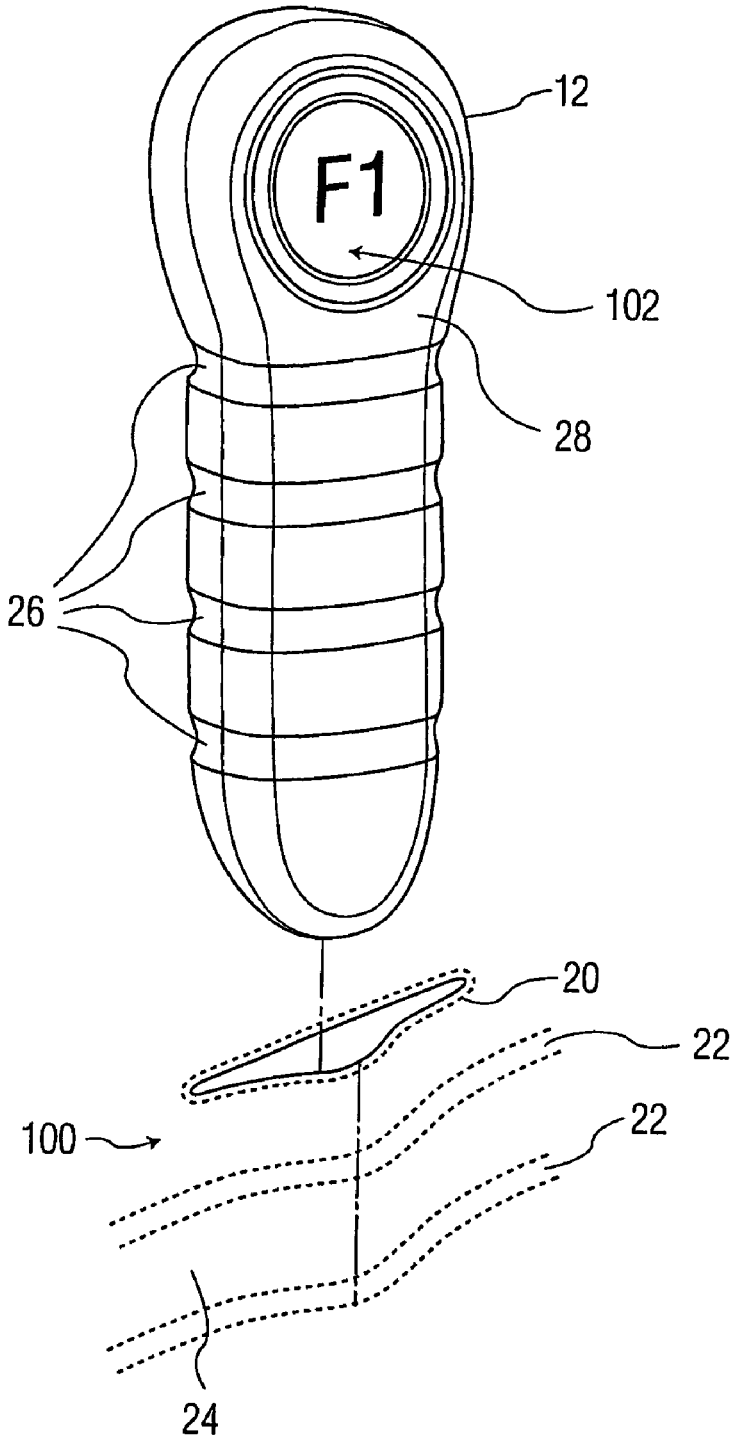
FIG. 4 is a view of an alternative embodiment of a fabric interconnect in accordance with the present invention and an electronic device for use with the fabric interconnect.
Figure 5:
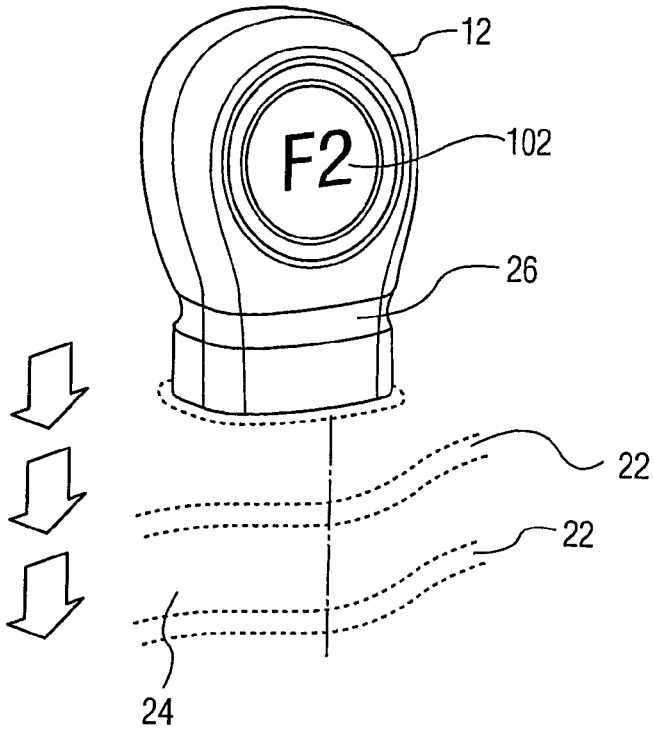
FIG. 5 is a view of the fabric interconnect of FIG. 4 with the electronic device inserted.
Figure 6:
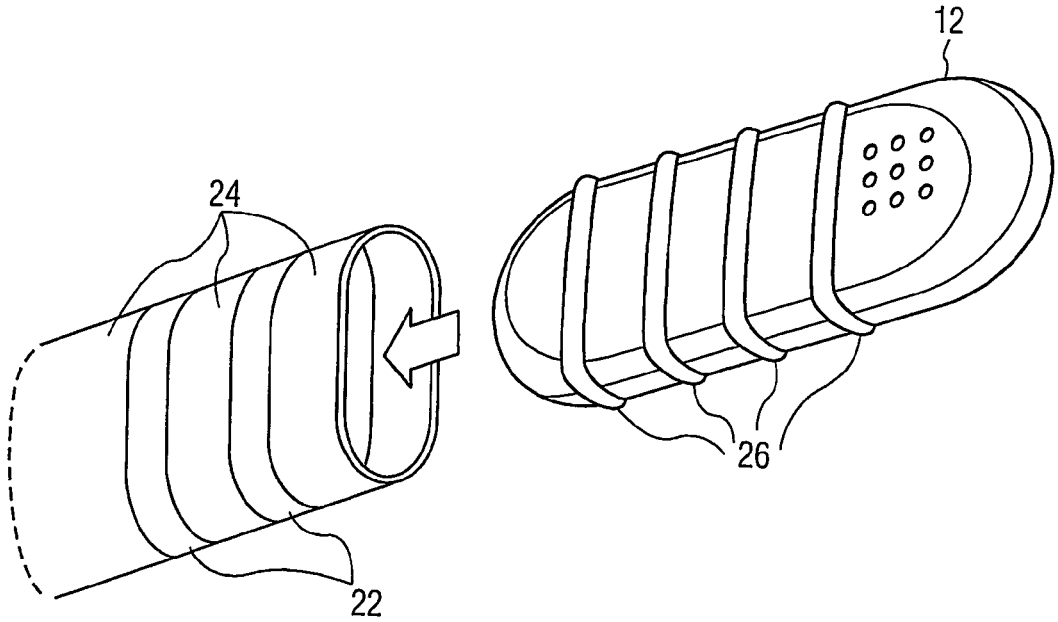
FIG. 6 is a view of an other alternative embodiment of a fabric interconnect in accordance with the present invention and an electronic device for use with the fabric interconnect.

Referring to FIGS. 4-6, there is shown an alternative embodiment of a fabric interconnect in accordance with the present invention and an electronic device for use with the fabric interconnect, generally represented by reference numeral 100. Fabric interconnect 100 includes at least two conductive inner surfaces, as will be discussed later in detail. Features common to both the embodiments of fabric interconnect 10 and 100 are denoted with the same reference numbers.

Referring to FIGS. 4-6, fabric interconnect 100 comprises a portion of garment 14 having a chamber 20 formed by a plurality of first inner surfaces 22 and a plurality of second inner surfaces 24. First inner surfaces 22 are substantially electrically conductive. Second inner surfaces 24 are substantially electrically non-conductive. In addition, at least one fabric electrode 30 (not shown) is coupled to the conductive portion (first inner surfaces 24) of chamber 20.

Fabric interconnect 100 is a seamless tube or chamber having a substantially tubular/oval shape. However, alternative shapes for fabric interconnect 100 can also be used including circular or square. Preferably, fabric interconnect 100 is made of a material with elasticity.

Electronic enclosure 12 includes a casing 28 that has conductive areas 26 and a display device 102, such as an LCD. Casing 28 may be made of any conventional material such as plastic and conductive areas 26 may be made of conductive carbonized plastic. Conductive areas 26 are internally connected to, and part of, an electronics circuit (not shown) inside the enclosure, which requires selective opening and closing of the connection with the electrodes 22 of garment 14. As noted above the chamber or tube has an opening (which is post knitting intervention) that allows the insertion of electronics enclosure 12 into the chamber.

Electronic enclosure 12 can be aligned in the chamber to a plurality of positions, thereby enabling the electronic device to introduce different functionalities. For example, by pushing or pulling electronic enclosure 12 within the chamber a user can bring the one or more conductive areas of the first inner surface 22 of the chamber in contact with the outer conductive surface area 26 of the electronic device. Accordingly, a user can select different functionalities corresponding to the various positions, by inserting the electronic device further or less into the chamber. An indication of the different functionalities is displayed on display device 102.

Referring to FIG. 5, fabric interconnect 100 is shown with the insertion of electronic enclosure 12. The insertion of electronic enclosure 12 enables the conductive area 26 of the electronic device to be in contact with the conductive first inner surface 22 of fabric interconnect 10. The contact of conductive area 26 and first inner surface 22 forms an interconnection.

The present invention having been thus described with particular reference to the preferred forms thereof, it will be obvious that various changes and modifications may be made therein without departing from the spirit and scope of the present invention as defined in the appended claims.

What is claimed is:

1. A fabric interconnect for connecting a garment and at least one electronics enclosure having at lease one conductive area on an outer surface, the fabric interconnect comprising:

one or more chambers for accommodating at least one electronics enclosure, at least one chamber having at least one substantially electrically conductive surface portion connected to one or more fabric electrodes in the garment and at least one substantially electrically non-conductive surface portion, wherein at least one chamber is at least substantially seamlessly manufactured so that at least one conductive area of the electronics enclosure and at least one conductive surface portion of the chamber accommodating the electronics enclosure can selectively make electrical contact to form an electrical interconnection between one or more fabric electrodes of the garment and the electronics of the electronics enclosure, wherein the electronics enclosure is positioned relative to the chamber via a force applied to the electronics enclosure and/or the chamber, and wherein the force applied to the electronics enclosure is a rotating force.

2. The fabric interconnect of claim 1, wherein at least one electronics enclosure is configured to be rotated within at least one accommodating chamber so as to bring a conductive area of the electronics enclosure and at least one conductive surface portion into electrical contact and thereby form an electrical interconnection between the electronics enclosure and one or more fabric electrodes of the garment.

3. The fabric interconnect of claim 1, wherein the conductive and non-conductive surface portions are flexible.

4. The fabric interconnect of claim 1, wherein the conductive and non-conductive surface portions are elastic.

5. The fabric interconnect of claim 1, wherein the chamber has a tube-like shape.

6. A fabric interconnect for connecting a garment and one or more electronics enclosures, the fabric interconnect comprising:

two or more substantially electrically conductive surface portions connected to one or more fabric electrodes in a garment, the conductive surface portions being separated from one another by at least one non-conductive surface portion disposed therebetween, wherein the two or more conductive surfaces and at least one non-conductive surface are manufactured so as to form one or more chambers suitable for accommodating at least one electronics enclosure, the electronics enclosure having at least one conductive interface, and wherein the two or more conductive surfaces electrically cooperate with the at least one conductive interface so that ene two or more different functions may be accomplished depending on the relative position of the at least one conductive interface with respect to the conductive surfaces.

7. The fabric interconnect of claim 6, wherein the electronics enclosure is operatively associated with a monitor for monitoring biological conditions.

8. An electronics enclosure for use with a fabric interconnect in a garment, the electronics enclosure comprising:

a casing with one or more substantially electrically conductive interfaces; and electronics operatively connected to at least one conductive interface, wherein the electronics enclosure is configured to be removably inserted into a substantially seamless chamber of the fabric interconnect so that at least one conductive interface electrically cooperates with two or more conductive portions of the chamber to form an interconnection between one or more fabric electrodes of the garment and the electronics of the electronics enclosure, wherein two or more functionalities correspond to a position of the electronics enclosure relative to the two or more conductive portions of a chamber accommodating the electronics enclosure.

9. The electronics enclosure of claim 8, wherein the electronics enclosure has at least one indicator for indicating one or more electronics enclosure functionalities.

10. The electronics enclosure of claim 9, wherein one indicator is in the form of a display.

11. The electronics enclosure of claim 8, wherein the conductive interface includes a number of electrically conductive areas with a number electrically non-conductive areas adjacent thereto that separate the plurality of electrically conductive areas.

12. The electronics enclosure of claim 11, wherein the two or more conductive portions of the chamber are connected to the one or more fabric electrodes, the conductive portions being spaced apart from one another with at least one non-conductive portion located therebetween.

* * * * *